US006343654B1

(12) United States Patent
Brammer

(10) Patent No.: US 6,343,654 B1
(45) Date of Patent: Feb. 5, 2002

(54) ELECTRIC POWER PACK FOR SUBSEA WELLHEAD HYDRAULIC TOOLS

(75) Inventor: Norman Brammer, Aberdeen (GB)

(73) Assignee: ABB Vetco Gray, Inc., Houston, TX (US)

( * ) Notice: Subject to any disclaimer, the term of this patent is extended or adjusted under 35 U.S.C. 154(b) by 0 days.

(21) Appl. No.: 09/449,869

(22) Filed: Nov. 29, 1999

Related U.S. Application Data

(60) Provisional application No. 60/110,665, filed on Dec. 2, 1998.

(51) Int. Cl.[7] ..... E21B 23/00

(52) U.S. Cl. ..... 166/338; 166/66.6; 166/368; 166/367; 166/350

(58) Field of Search ..... 166/66.6, 350, 166/359, 367, 368, 358, 66.4

(56) References Cited

U.S. PATENT DOCUMENTS

| | | | | | |
|---|---|---|---|---|---|
| 3,665,955 | A | * | 5/1972 | Conner, Sr. | 137/495 |
| 3,675,720 | A | * | 7/1972 | Sizer | 166/314 |
| 3,921,500 | A | * | 11/1975 | Silcox | 166/368 |
| 4,337,829 | A | | 7/1982 | Banzoli et al. | 166/366 |
| 4,391,330 | A | * | 7/1983 | Kiefer | 166/341 |
| 4,493,374 | A | | 1/1985 | Magee, Jr. | |
| 4,632,188 | A | * | 12/1986 | Schuh et al. | 166/368 |
| 4,880,060 | A | * | 11/1989 | Schwendemann et al. | 166/368 |
| 5,088,558 | A | | 2/1992 | Mohn | |
| 5,188,180 | A | * | 2/1993 | Jennings | 166/338 |
| 5,320,182 | A | | 6/1994 | Mendez | |
| 5,404,946 | A | | 4/1995 | Hess | |
| 6,012,518 | A | * | 1/2000 | Pringle et al. | 166/66.4 |

FOREIGN PATENT DOCUMENTS

| | | | |
|---|---|---|---|
| GB | 1399028 | 6/1975 | 33/35 |

* cited by examiner

*Primary Examiner*—David Bagnell
*Assistant Examiner*—Frederick L. Lagman
(74) *Attorney, Agent, or Firm*—Bracewell & Patterson L.L.P.

(57) ABSTRACT

A device for supplying hydraulic pressure to one or more hydraulically actuable components in a well production system and positioned within the well bore including a reservoir, and electrically powered pump, and a controller each positioned within the well bore and carried on the component. The controller operates the pump to supply fluid from the reservoir to actuate the components. Additionally, valves to route the fluid to the components and sensors to sense when the components are actuated are included.

23 Claims, 1 Drawing Sheet

ELECTRIC POWER PACK FOR SUBSEA WELLHEAD HYDRAULIC TOOLS

CROSS-REFERENCE TO RELATED APPLICATIONS

This application claims the benefit of provisional patent application Ser. No. 60/110,665, filed on Dec. 2, 1998, in the United States Patent & Trademark Office.

TECHNICAL FIELD

This invention relates in general to remotely actuated tools for performing operations on subsea wellheads, and in particular to tools operated by hydraulic power.

BACKGROUND OF THE INVENTION

A typical subsea well production system has a wellhead and a christmas tree installed thereon. A riser extends upward from the Christmas tree, and together with the tree and wellhead form a well bore. Various well components, such as a tubing hanger, a running tool, and a test tree, are positioned in the bore and must be actuated to perform their respective function. In conventional subsea well production systems, these components are hydraulically actuated through passages which extend upward within the bore to the surface. A fluid reservoir and a pump on the surface provide hydraulic pressure to the components.

Conventional systems require long hydraulic umbilical lines to span from the surface to the sea floor. The deeper the subsea well, the longer the umbilical lines must be, and the more flexure introduced into the hydraulic system as the lines flex from the stress of the hydraulic pressure. This flexure reduces the precision to which the components can be operated. Also, there is a great distance between the controlling pump and the component being actuated which increases response times to actuate the components. Finally, the fluid in the long umbilical lines must traverse a large distance and as such are easily contaminated.

Therefore, there is a need for a hydraulic actuation system that absolves the need for transmission of hydraulic fluid through long umbilical lines and minimizes the volume of fluid to provide fast, precise, and clean actuation of various well components.

SUMMARY OF THE INVENTION

The present invention presents a subsea apparatus for performing a task on a subsea wellhead assembly located adjacent to a sea floor. The wellhead assembly has a riser extending to a platform at a surface of the sea. The apparatus has a first hydraulically actuated component adapted to be lowered from the platform through the riser into engagement with the subsea wellhead assembly for performing a task on the subsea wellhead assembly. The apparatus has reservoir containing a fluid and the reservoir is carried by the first component. An electrically powered pump is carried by the first component for pumping fluid from the reservoir to the first component to actuate the first component. An electrically actuable controller is carried by the first component for receiving remote signals from the platform and electrically operating the pump.

A second hydraulically actuable component is adapted to be lowered from the platform through the riser simultaneously with the first component. A plurality of valves are interconnected between the pump and the first and second components. The controller is adapted to receive remote signals from the platform to actuate the valves and route fluid from the pump selectively to the components.

The first component is adapted to be lowered through the riser on a string of conduit. A power line to the pump is adapted to be carried by the string of conduit. A sensor is carried by the first component for sensing actuation of the first component and signaling the controller. A tubular joint is carried by the first component and the fluid reservoir, pump, and controller are mounted to the joint. The reservoir and the pump are positioned in close proximity to the first component. The first component may be part of a running tool for installing a string of tubing within the subsea wellhead assembly.

The present invention also presents a subsea apparatus for performing a task to a subsea wellhead assembly located adjacent to a sea floor. The wellhead assembly has a riser extending to a platform at a surface of the sea. The apparatus has a hydraulically actuable running tool adapted to be lowered through the riser and into engagement with the subsea wellhead assembly for installing a string of tubing within the subsea wellhead assembly. A reservoir is carried by the running tool for containing fluid. An electrically powered pump is carried by the running tool for pumping fluid from the reservoir to the running tool to actuate the running tool. An electrically actuable controller is carried by the running tool for receiving remote signals from the platform and electrically operating the pump.

A second hydraulically actuable component is adapted to be lowered from the platform through a riser simultaneously with the running tool. A plurality of valves are interconnected between the pump and the running tool and the second component. The controller is adapted to receive remote signals from the platform to actuate the valves and route fluid from the pump selectively to the running tool and second component. The second component may be a test tree valve or a latch for disconnecting a running string from at least a portion of the running tool while the running tool is in engagement with the subsea wellhead assembly.

A sensor is carried by the running tool for sensing actuation of the running tool and signaling the controller. A tubular joint is carried by the running tool and the fluid reservoir, pump, and controller are mounted to the joint.

In addition to the second component, the apparatus may have a latch for disconnecting a running string from at least a portion of the running tool while the running tool is in engagement with the subsea wellhead assembly. Here, the plurality of valves is interconnected between the running tool, second component, and latch such that the controller can actuate the valves and route fluid from the pump selectively to the running tool, second component, and latch. Here also, the second component may be a test tree valve.

The present invention also presents a method from performing a task on a subsea wellhead assembly located adjacent to a sea floor. The wellhead assembly has a riser extending to a platform at a surface of the sea. The method includes the step of providing a first hydraulically actuable component having a reservoir containing a fluid, an electrically powered pump, and an electrically actuable controller carried by the first component. The component is lowered through the riser into engagement with the subsea wellhead assembly. The controller is signaled from the platform to actuate the pump and pump fluid from the reservoir to the first component to actuate the first component to perform a task on the subsea wellhead.

A second hydraulically actuable component is lowered simultaneously with the first component and the controller is signaled from the platform to actuate valves between the pump and the components to route fluid from the pump selectively to the components. The actuation of the first component is sensed and the controller is signaled. The first component may be part of a running tool for installing a string of tubing within the subsea wellhead assembly.

The present invention also presents a method for installing a string of tubing within a subsea wellhead assembly located adjacent to a sea floor and having a riser extending to a platform at a surface of the sea. The method includes the step of connecting the tubing to a tubing hanger. A running tool having a fluid reservoir, an electrically powered pump, and an electrically actuable controller carried thereon is secured to the tubing hanger. A string of conduit is secured to the running tool and the tubing is lowered into the well and the running tool into the subsea wellhead assembly. The controller is signaled form the platform to actuate the pump thereby supplying hydraulic pressure to actuate the running tool to engage the wellhead assembly and set the tubing hanger.

A second component is secured to the running tool and lowered into the subsea wellhead assembly simultaneously with the running tool. The controller is signaled from the platform to activate valves between the pump and the running tool and second component to route fluid from the pump selectively to the running tool and the second component. The second component may be a test tree valve or a latch for disconnecting a running string from at least a portion of the running tool while the running tool is in engagement with the subsea wellhead assembly.

BEST MODE FOR CARRYING OUT THE INVENTION

Figure 1A:
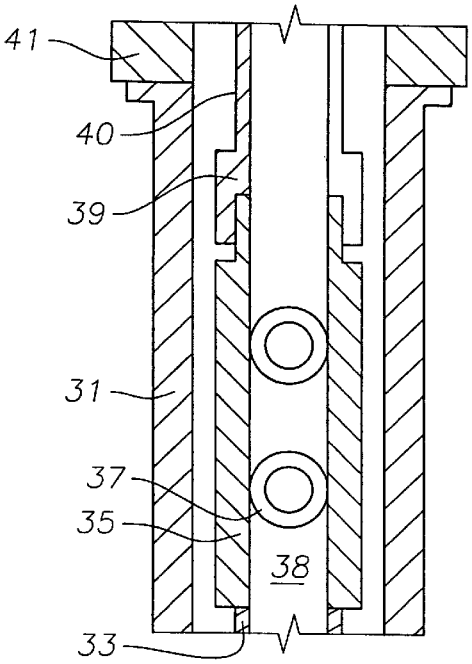
FIGS. 1A and 1B comprise a schematic sectional view of a set of well tools for running tubing, landing the tubing hanger in a subsea christmas tree, and testing the tubing hanger.
Figure 1B:
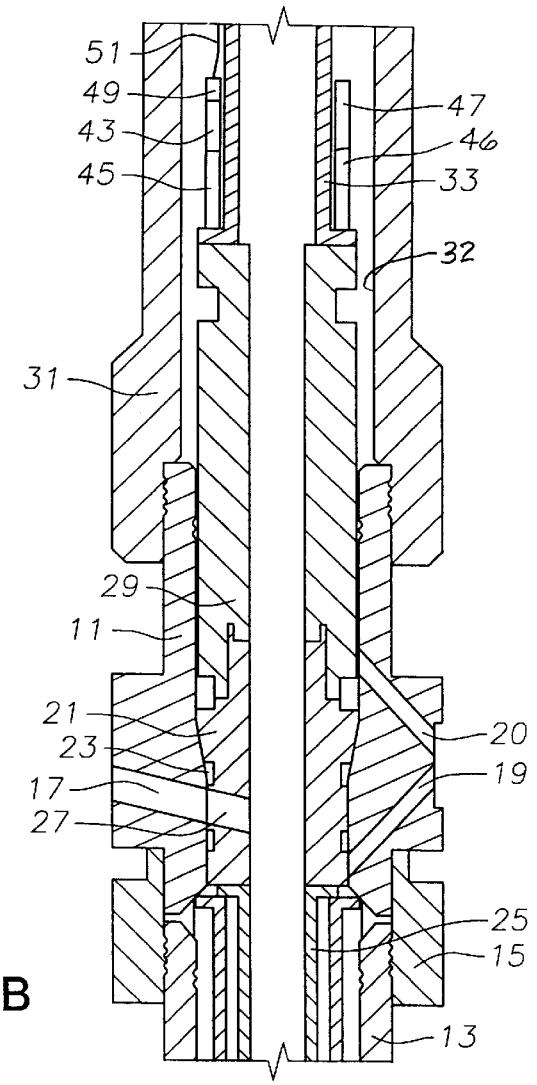

Referring to FIGS. 1A and 1B, a Christmas tree 11 is shown installed on wellhead housing 13 at the seabed. A connector 15 connects tree 11 to wellhead housing 13. In the embodiment shown, tree 11 has a production outlet 17 which extends laterally outward. Tree 11 also has a lower annulus port 19 and an upper annulus port 20 which are connected to each other by a valve (not shown). Further, each annulus port 19, 20 contains a separate valve (not shown). A tubing hanger 21 is shown being landed in the bore of tree 11. Tubing hanger 21 is sealed within the bore of tree 11 by seals 23. Tubing hanger 21 supports a string of tubing 25 which extends into the well. A tubing hanger production outlet 27 extends laterally outward and registers with production outlet 17. An annulus surrounding the string of tubing 25 communicates with annulus port 19. Annulus ports 19, 20 bypass tubing hanger 21 to provide access to the tubing annulus from above.

A schematically shown running tool 29 is shown attached to the upper end of tubing hanger 21. Running tool 29 is used to lower tubing 25 into the well and set tubing hanger 21 in tree 11. Running tool 29 is of a type which has pistons (not shown) which apply downward force to tubing hanger 21 to cause seals 23 to set. Running tool 29 also sets a locking member (not shown) to lock tubing hanger 21 in tree 11.

A riser 31 secures to the upper end of tree 11 and extends around running tool 29 upward to a vessel (not shown) at the surface. Together riser 31, tree 11, and wellhead 13 form a continuous bore 32. A tubularjoint 33 is connected to the upper end of running tool 29 and extends upward a short distance to a test tree 35, shown in FIG. 1A. Test tree 35 has two ball valves 37 which will open and close axial passage 38 extending through test tree 35. Test tree 35 is used to control production fluid flowing upward through tubing 25 after tubing hanger 21 has been set and the well perforated. Ball valves 37 are preferably independently actuable by hydraulic power which moves pistons (not shown) contained within test tree 35.

A hydraulic disconnect 39 is connected to the upper end of test tree 35. Hydraulic disconnect 39 is actuable by hydraulic power to disconnect the running string 40 from test tree 35 and the tools located below. When tubing hanger 21 has landed in tree 11, hydraulic disconnect 39 will be located below a blow-out preventer (BOP) 41 which is mounted in the string of riser 31. Hydraulic disconnect 39 is used in an emergency, such as leakage of production fluid through ball valves 37 of test tree 35. Disconnecting running string 40 from test tree 35 and pulling upward enables BOP 41 to be closed to contain the pressure in riser 31. The well can then be killed, if necessary, by pumping down choke and kill lines (not shown) which extend alongside riser 31 to a point in riser 31 below BOP 41. This point is in communication with upper annulus port 20. A cross-over line (not shown) from the junction of annulus ports 19, 20 to production passage 17 provides access to the interior of production tubing 25 for killing the well in an emergency.

Running tool 29 requires hydraulic power to set and release from tubing hanger 21. Test tree 35 requires hydraulic power to open and close ball valves 37. Hydraulic disconnect 39 requires hydraulic power to disconnect from test tree 35. There may be additional hydraulic actuated valves employed when running tubing 25, including a retainer valve and a lubricator valve. In the past, the hydraulic power has been furnished via a hydraulic line extending along the running string 40. In this invention, hydraulic fluid pressure is not furnished from the drilling vessel, rather electrical power from the vessel is supplied to an electrical motor 43 incorporated with the tubing running assembly.

Motor 43 is mounted above tubing hanger 21 on the running tool assembly at a convenient position, such as alongside joint 33 directly above and adjacent running tool 29. Motor 43 drives a pump 45 which pumps hydraulic fluid drawn from a reservoir 46, also located on the running tool assembly. An accumulator 47 is mounted next to pump 45 for accumulating pressure in the hydraulic circuit. Referring to the schematic of FIG. 2, an electrical controller circuit 49 is also located on the running tool assembly for controlling motor 43 and the various hydraulic functions. Controller 49 is connected to an electrical cable 51 which extends alongside running string 40 to the vessel. Electrical cable 51 supplies power to motor 43 as well as provides signals to controller 49 to control motor 43 and actuate the various hydraulic tools.

Figure 2:
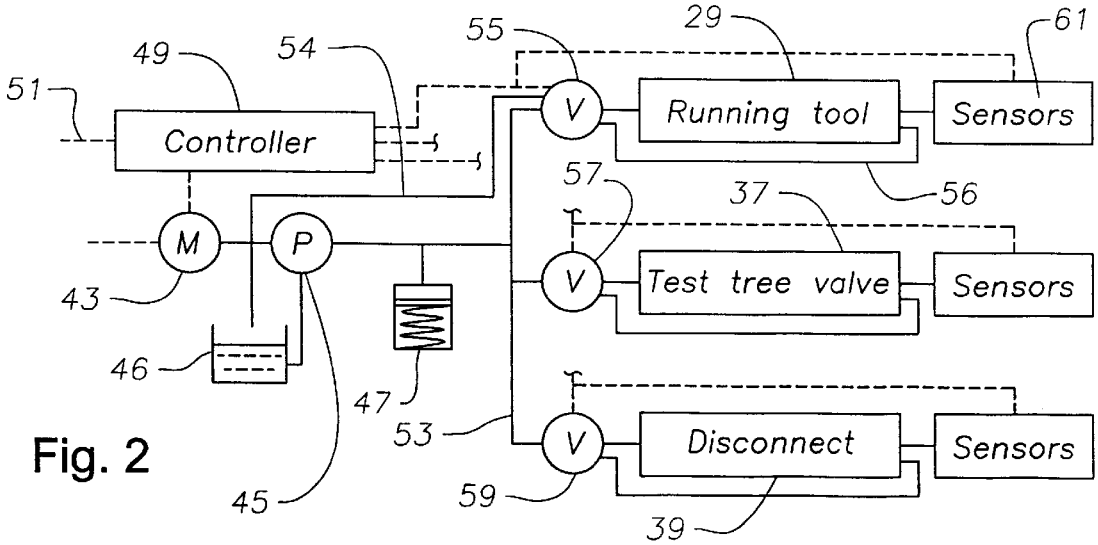
FIG. 2 is an electrical and hydraulic schematic of the well tools of FIGS. 1A and 1B.

Pump 43 and accumulator 47 are connected to hydraulic lines 53 for supplying hydraulic pressure to the various hydraulic tools. As shown in FIG. 2, this includes running tool 29, test tree valves 37, and hydraulic disconnect 39. Running tool 29, test tree valves 37, and hydraulic disconnect 39 have hydraulic lines 56 which supply and return hydraulic fluid from the various piston members therein. Hydraulic lines 56 are connected to pilot valves 55, 57 and 59. Pilot valves 55, 57, 59 are also connected to lines 53, 54.

Pilot valve 55 is electrically actuated by controller 51 for directing hydraulic fluid pressure to and from running tool 29 via lines 53, 54 and 56. In practice, there will be likely more than one pilot valve 55 depending on the type of running tool and its various functions. Pilot valve 57 will be connected to the test tree valves 37 and hydraulic lines 53, 54 and 56 for controlling ball valves 37. If ball valves 37 are independently actuable, each will have its own pilot valve 57. Each pilot valve 57 is controlled by controller 49. Similarly, a pilot valve 59 is controlled by controller 49 for supplying and returning hydraulic fluid via hydraulic lines 53, 54 and 56 to hydraulic disconnect valve 39. The hydraulically actuated components of running tool 29, test tree valve 37 and hydraulic disconnect 39 may require hydraulic pressure on both the power and return stroke and/or they may be returned by spring force.

Position sensors 61 are mounted to running tool 29, test tree valve 37 and hydraulic disconnect 39. Position sensors 61 are electrically connected to controller 49. Position sensors 61 will sense the various positions of the components of running tool 29, test tree valve 37 and hydraulic disconnect 39 and provide a signal to controller 49. Controller 49 forwards the signals to the drilling rig via electrical cable 51. For example, the sensors 61 for test tree valve 37 would indicate whether the valves 37 are in the open or closed positions.

In operation, the operator provides signals to controller 49 over cable 51. Controller 49 will turn on motor 43, which operates pump 45 to provide hydraulic fluid pressure in hydraulic lines 53. Accumulator 47 will maintain a desired pressure level in hydraulic lines 53. The operator will provide various signals to controller 49, which in turn will actuate the various tools 29, 37 or 39 by signaling the pilot valves 55, 57, 59. Hydraulic fluid pressure will be supplied and returned from the various hydraulic lines 54, 56. Sensors 61 will indicate whether the various tools have moved to the desired positions.

The present invention has several advantages over the prior art. The system is compact and universal for use with existing well systems or new designs. Because the hydraulic pump is situated near the component being operated, there is no need for long hydraulic umbilical lines. This reduces the amount of hydraulic fluid used and allows the system to remain entirely closed, thus minimizing the possibility of contamination. Also, there is no need for a fluid return line to the surface which greatly increases the amount of fluid needed and the chances of contamination. Without the long umbilical lines, there is very little flexure in the in the closed hydraulic system and the components can be controlled with higher degrees of precision than with conventional systems. Sensors on the components can provide more accurate feedback through the controller to the surface. Finally, the placement of the pump near the components improves system response times for actuation.

While the invention has been shown or described in only some of its forms, it should be apparent to those skilled in the art that it is not so limited, but is susceptible to various changes without departing from the scope of the invention.

I claim:

1. A subsea apparatus for performing a task on a subsea wellhead assembly located adjacent to a sea floor at an upper end of a well, the wellhead assembly having a riser extending to a platform at a surface of the sea, the apparatus comprising:

a first hydraulically actuable component adapted to be lowered from the platform through the riser into engagement with the subsea wellhead assembly above the well for actuating a member of the subsea wellhead assembly;

a reservoir containing a fluid and carried by the first component;

an electrically powered pump carried by the first component for pumping fluid from the reservoir to the first component to actuate the first component; and an electrically actuable controller carried by the first component for receiving remote signals from the platform and electrically operating the pump.

2. The apparatus of claim 1 wherein the first component is adapted to be lowered through the riser on a string of conduit.

3. The apparatus of claim 1 wherein the first component is adapted to be lowered through the riser on a string of conduit, and a power line to the pump is adapted to be carried by the string of conduit along an exterior of the string of conduit.

4. The apparatus of claim 1 wherein the reservoir and the pump are positioned in close proximity to the first component.

5. The apparatus of claim 1 wherein the first component is part of a running tool for installing a string of tubing within the subsea wellhead assembly.

6. A subsea apparatus for performing a task on a subsea wellhead assembly located adjacent to a sea floor, the wellhead assembly having a riser extending to a platform at a surface of the sea, the apparatus comprising:

a first hydraulically actuable component adapted to be lowered from the platform through the riser into engagement with the subsea wellhead assembly for performing a task on the subsea wellhead assembly;

a reservoir containing a fluid and carried by the first component;

an electrically powered pump carried by the first component for pumping fluid from the reservoir to the first component to actuate the first component;

an electrically actuable controller carried by the first component for receiving remote signals from the platform and electrically operating the pump;

a second hydraulically actuable component adapted to be lowered from the platform through the riser simultaneously with the first component; and a plurality of valves interconnected between the pump and the first and second components;

wherein the controller is adapted to receive remote signals from the platform to actuate the valves and route fluid from the pump selectively to the components.

7. A subsea apparatus for performing a task on a subsea wellhead assembly located adjacent to a sea floor, the wellhead assembly having a riser extending to a platform at a surface of the sea, the apparatus comprising:

a first hydraulically actuable component adapted to be lowered from the platform through the riser into engagement with the subsea wellhead assembly for performing a task on the subsea wellhead assembly;

a reservoir containing a fluid and carried by the first component;

an electrically powered pump carried by the first component for pumping fluid from the reservoir to the first component to actuate the first component;

an electrically actuable controller carried by the first component for receiving remote signals from the platform and electrically operating the pump; and a sensor carried by the first component for sensing actuation of the first component and signaling the controller.

8. A subsea apparatus for performing a task on a subsea wellhead assembly located adjacent to a sea floor, the wellhead assembly having a riser extending to a platform at a surface of the sea, the apparatus comprising:

first hydraulically actuable component adapted to be lowered from the platform through the riser into engagement with the subsea wellhead assembly for performing a task on the subsea wellhead assembly;

a reservoir containing a fluid and carried by the first component;

an electrically powered pump carried by the first component for pumping fluid from the reservoir to the first component to actuate the first component;

an electrically actuable controller carried by the first component for receiving remote signals from the platform and electrically operating the pump; and a tubular joint carried by the first component, wherein the fluid reservoir, pump, and controller are mounted to the joint.

9. A subsea apparatus for performing a task to a subsea wellhead assembly located adjacent to a sea floor at an upper end of a well, the wellhead assembly having a riser extending to a platform at a surface of the sea, the apparatus comprising:

a hydraulically actuable running tool adapted to be connected to a string of tubing and lowered through the riser and into engagement with the subsea wellhead assembly above the well for installing the string of tubing within the subsea wellhead assembly;

a reservoir carried by the running tool for containing fluid;

an electrically powered pump carried by the running tool for pumping fluid from the reservoir to the running tool to actuate the running tool; and an electrically actuable controller carried by the running tool for receiving remote signals from the platform and electrically operating the pump.

10. A subsea apparatus for performing a task to a subsea wellhead assembly located adjacent to a sea floor, the wellhead assembly having a riser extending to a platform at a surface of the sea, the apparatus comprising:

a hydraulically actuable running tool adapted to be lowered through the riser and into engagement with the subsea wellhead assembly for installing a string of tubing within the subsea wellhead assembly;

a reservoir carried by the running tool for containing fluid;

an electrically powered pump carried by the running tool for pumping fluid from the reservoir to the running tool to actuate the running tool;

an electrically actuable controller carried by the running tool for receiving remote signals from the platform and electrically operating the pump;

a second hydraulically actuable component adapted to be lowered from the platform through the riser simultaneously with the running tool; and a plurality of valves interconnected between the pump and the running tool and the second component;

wherein the controller is adapted to receive remote signals from the platform to actuate the valves and route fluid from the pump selectively to the running tool and second component.

11. The apparatus of claim 10 wherein the second component is a test tree valve.

12. The apparatus of claim 10 wherein the second component is a latch for disconnecting a running string from at least a portion of the running tool while the running tool is in engagement with the subsea wellhead assembly.

13. The apparatus of claim 10 further comprising a sensor carried by the running tool for sensing actuation of the running tool and signaling the controller.

14. The apparatus of claim 10 further comprising a tubular joint carried by the running tool wherein the fluid reservoir, pump, and controller are mounted to the joint.

15. The apparatus of claim 10 further comprising a latch for disconnecting a running string from at least a portion of the running tool while the running tool is in engagement with the subsea wellhead assembly;

wherein the plurality of valves is interconnected between the running tool, second component, and latch such that the controller can actuate the valves and route fluid from the pump selectively to the running tool, second component, and latch; and wherein the second component is a test tree valve.

16. A method for performing a task on a subsea wellhead assembly located adjacent to a sea floor at an upper end of a well, the wellhead assembly having a riser extending to a platform at a surface of the sea, the method comprising the steps of:

providing a first hydraulically actuable component having a reservoir containing a fluid, an electrically powered pump, and an electrically actuable controller carried by the first component;

lowering the component through the riser into engagement with the subsea wellhead assembly at a point above the well; and signaling the controller from the platform to actuate the pump and pumping fluid from the reservoir to the first component to actuate the first component to perform a task on the subsea wellhead.

17. The method of claim 16 wherein the first component is a part of a running tool for installing a string of tubing within the subsea wellhead assembly.

18. A method for performing a task on a subsea wellhead assembly located adjacent to a sea floor, the wellhead assembly having a riser extending to a platform at a surface of the sea, the method comprising the steps of:

providing a first hydraulically actuable component having a reservoir containing a fluid, an electrically powered pump, and an electrically actuable controller carried by the first component;

lowering the component through the riser into engagement with the subsea wellhead assembly;

signaling the controller from the platform to actuate the pump and pumping fluid from the reservoir to the first component to actuate the first component to perform a task on the subsea wellhead;

lowering a second hydraulically actuable component simultaneously with the first component; and signaling the controller from the platform to actuate valves between the pump and the components to route fluid from the pump selectively to the components.

19. A method for performing a task on a subsea wellhead assembly located adjacent to a sea floor, the wellhead assembly having a riser extending to a platform at a surface of the sea, the method comprising the steps of:

providing a first hydraulically actuable component having a reservoir containing a fluid, an electrically powered pump, and an electrically actuable controller carried by the first component;

lowering the component through the riser into engagement with the subsea wellhead assembly;

signaling the controller from the platform to actuate the pump and pumping fluid from the reservoir to the first component to actuate the first component to perform a task on the subsea wellhead; and sensing actuation of the first component and signaling the controller.

20. A method for installing a string of tubing within a subsea wellhead assembly, the wellhead assembly located adjacent to a sea floor at an upper end of a well and having a riser extending to a platform at a surface of the sea, the method comprising the steps of:

connecting the tubing to a tubing hanger;

securing a running tool to the tubing hanger, the running tool having a fluid reservoir, an electrically powered pump, and an electrically actuable controller carried thereon;

securing a string of conduit to the running tool and lowering the tubing into the well and the running tool into the subsea wellhead assembly to a position above the well; and signaling the controller from the platform to actuate the pump thereby supplying hydraulic pressure to actuate the running tool to engage the wellhead assembly and set the tubing hanger.

21. A method for installing a string of tubing within a subsea wellhead assembly, the wellhead assembly located adjacent to a sea floor and having a riser extending to a platform at a surface of the sea, the method comprising the steps of:

connecting the tubing to a tubing hanger;

securing a running tool to the tubing hanger, the running tool having a fluid reservoir, an electrically powered pump, and an electrically actuable controller carried thereon;

securing a string of conduit to the running tool and lowering the tubing into the well and the running tool into the subsea wellhead assembly;

signaling the controller from the platform to actuate the pump thereby supplying hydraulic pressure to actuate the running tool to engage the wellhead assembly and set the tubing hanger;

securing a second component to the running tool and lowering the second component into the subsea wellhead assembly simultaneously with the running tool; and signaling the controller from the platform to actuate valves between the pump and the running tool and second component to route fluid from the pump selectively to the running tool and the second component.

22. The method of claim 21 wherein the second component is a test tree valve.

23. The method of claim 21 wherein the second component is a latch for disconnecting a running string from at least a portion of the running tool while the running tool is in engagement with the subsea wellhead assembly.

* * * * *